US005407608A

United States Patent [19]

Knowlden et al.

[11] Patent Number: 5,407,608

[45] Date of Patent: Apr. 18, 1995

[54] PROCESS OF MANUFACTURING A GAS GENERATING MATERIAL

[75] Inventors: Leopard S. Knowlden, Gilbert, Ariz.; George W. Goetz, Rochester Hills, Mich.

[73] Assignee: TRW Vehicle Safety Systems Inc., Lyndhurst, Ohio

[21] Appl. No.: 183,135

[22] Filed: Jan. 18, 1994

Related U.S. Application Data

[63] Continuation of Ser. No. 595,047, Oct. 10, 1990, abandoned.

[51] Int. Cl.[6] ..... C06B 21/00

[52] U.S. Cl. ..... 264/3.4; 149/35; 149/109.6

[58] Field of Search ..... 264/3.3, 3.4, 3.5; 149/35, 109.6

[56] References Cited

U.S. PATENT DOCUMENTS

| | | | |
|---|---|---|---|
| 1,967,913 | 7/1934 | Tibbitts et al. | 52/20 |
| 2,889,216 | 6/1959 | Mulqueeny et al. | 52/21 |
| 3,895,980 | 7/1975 | Makay | 149/8 |
| 3,920,575 | 11/1975 | Shiki et al. | 252/188.3 |
| 4,021,275 | 5/1977 | Kishi et al. | 149/35 |
| 4,994,212 | 2/1991 | Vos et al. | 264/3.3 |

FOREIGN PATENT DOCUMENTS

| | | | |
|---|---|---|---|
| 1087852 | 10/1980 | Canada | 149/35 |

*Primary Examiner*—Donald P. Walsh
*Assistant Examiner*—Chrisman D. Carroll
*Attorney, Agent, or Firm*—Tarolli, Sundheim & Covell

[57] ABSTRACT

A process for manufacturing a gas generating material includes preparing a hot solution of a metal azide, preferably sodium azide, with metal oxide particles, preferably iron oxide particles, suspended in the solution. The metal azide is precipitated from the solution. The step of precipitating the metal azide from the solution includes cooling the hot solution to decrease the solubility of the metal azide in the solute. The metal azide precipitate and the iron oxide particles are then separated from the liquid.

29 Claims, 3 Drawing Sheets

PROCESS OF MANUFACTURING A GAS GENERATING MATERIAL

This is a continuation of application Ser. No. 07/595,047, filed on Oct. 10, 1990, now abandoned.

BACKGROUND OF THE INVENTION

1. Technical Field

The present invention relates to a method for manufacturing gas generating material, and in particular relates to a method for manufacturing a gas generating material which contains a metal azide and a metal oxide and which is used for generating gas to inflate a vehicle occupant restraint, such as an airbag.

2. Description of the Prior Art

U.S. Patent Application Ser. No. 528,144 filed May 24, 1990, now U.S. Pat. No. 4,994,212, assigned to the assignee of the present application, and entitled "Process for Manufacturing a Gas Generating Material" discloses a process for manufacturing an azide-containing gas generating material. The gas generating material is formed by preparing a wet mixture of a metal azide and a metal oxide. During tile manufacturing process, the formation of hazardous hydrazoic acid fumes ($HN_3$) is minimized by: (1) maintaining the wet mixture of the metal azide and metal oxide at a temperature not exceeding 30° C. and (2) maintaining the pH of the wet mixture of the metal azide and metal oxide at a value which is at least about 10.5. During the processing of the wet mixture of gas generating material, the mixture is repeatedly ground to reduce the particle size of one or more of the ingredients of the mixture. Once the wet mixture of gas generating material has been formed, excess liquid is removed from the mixture and the mixture is processed to form spheres granules which are molded to form bodies of gas generating material.

Canadian Patent 1,087,852 also discloses a process for making gas generating material.. In the process sodium azide is dissolved in heated water, and a metal oxide is added to the sodium azide water solution. The solution with the metal oxide added is then mixed to coat the metal oxide with sodium azide, and the coated metal oxide particles are recovered. Preferably, the coated metal oxide particles are recovered by evaporation of the water. The patent also refers to recovering the coated metal oxide particles by precipitation but does not explain how this is done.

SUMMARY OF THE INVENTION

The present invention relates to a process for manufacturing a gas generating material. The gas generating material is formed by preparing a hot solution of a soluble constituent, such as a metal azide, with an insoluble particulate, such as metal oxide particles, suspended in the solution. The metal azide is then precipitated from the solution by cooling the hot solution to decrease the solubility of the metal azide in the solution. As the metal azide is precipitated, it coats the metal oxide particles. Thus, particles are formed with metal oxide nuclei coated with crystals of metal azide. The solids are then separated from the solute. The solids are subsequently processed to form granules of gas generating material. The amount of the metal azide used in the process is such that the metal azide completely goes into solution. As a result, grinding the metal azide is unnecessary.

Preferably, sodium azide is the soluble metal azide constituent, water is the preferred solvent, and iron oxide is the preferred insoluble particulate. The relative ratios of the materials used are computed on the basis of the solubility of sodium azide at a relatively low temperature, on the order of 34° F., versus its solubility at a relatively high temperature, on the order of 220° F., and the desired ratio by weight of sodium azide to iron oxide in the final product.

The cost of the metal azide used in the process can be minimized by integrating the process for manufacturing the gas generating material with the metal azide manufacturing process.

BRIEF DESCRIPTION OF THE DRAWINGS

The foregoing and other objects and features of the present invention will become more apparent to one skilled in the art upon a consideration of the following description taken in connection with the accompanying drawings, wherein.

DESCRIPTION OF PREFERRED EMBODIMENTS OF THE INVENTION

Figure 1:
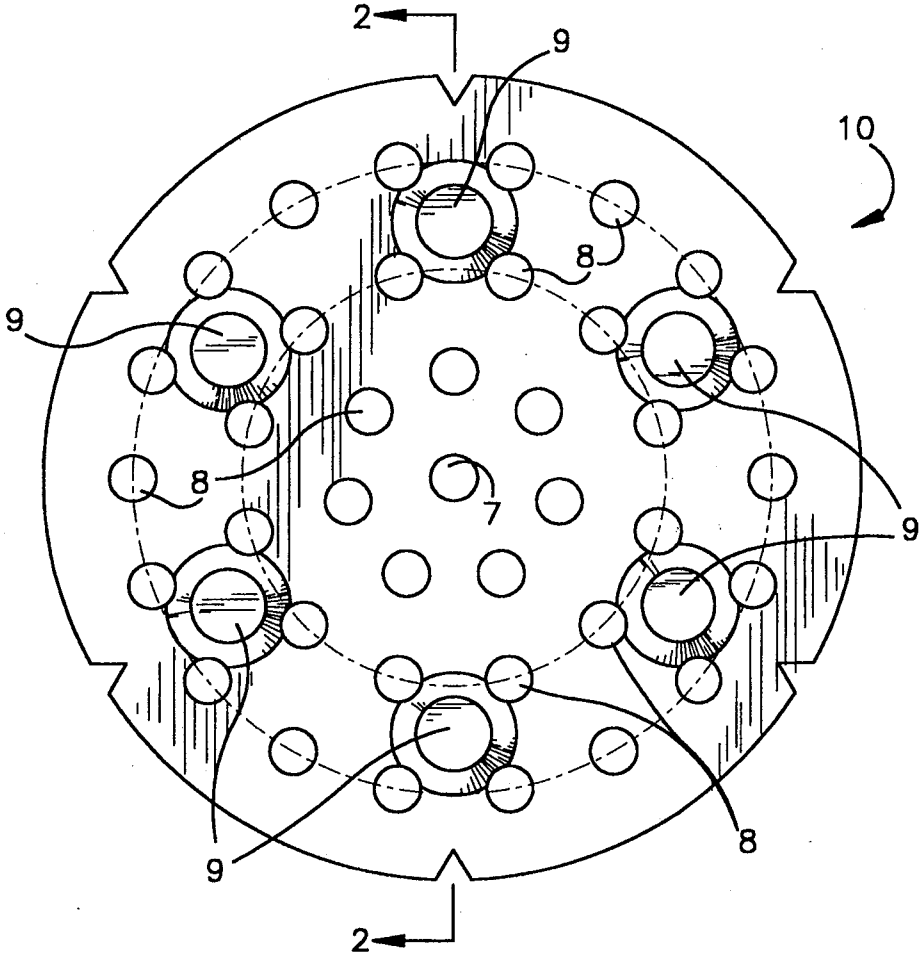
FIG. 1 is a plan view of a body of gas generating material used in a vehicle restraint system and made of material manufactured by the method of the present invention.

As shown in FIG. 1, 2 body 10 (known as a "grain") of gas generating material is used in an inflatable vehicle occupant restraint system to inflate an occupant restraint, such as an airbag. The body 10, or a plurality of bodies 10, of gas generating material could be used in many different types of inflatable restraint systems. One inflatable restraint system in which the bodies of gas generating material may be used is described in U.S. Pat. No. 4,817,828, assigned to the assignee of the present application, issued Apr. 4, 1989 and entitled "Inflatable Restraint System".

The body 10 of gas generating material includes a fuel which is a source of nitrogen gas and an oxidizer which reacts with the fuel. The body 10 of gas generating material also contains an oxidizing agent, an extruding aid and strengthening fibers. The preferred fuel or source of nitrogen gas is an alkali metal azide, such as sodium, potassium or lithium azide. Sodium azide is the most preferred alkali metal azide. The oxidizer is preferably a metal oxide. The metal of the metal oxide may be any metal lower in the electromotive series than the alkali metal. Examples of preferred metals are iron, copper, manganese, tin, titanium, or nickel, and combinations thereof. The most preferred oxidizer is iron oxide.

The oxidizing agent in the body 10 may be an alkali metal nitrate, chlorate, and/or perchlorate or combinations of the foregoing. At the present time, it is preferred to use sodium nitrate as the oxidizing agent. Relatively small amounts of an extrusion aid and strengthening fibers are provided in the body 10 of gas generating material. Bentonite is the preferred extrusion aid. Graphite fibers are preferably used as the strengthening fibers.

The body 10 of gas generating material has the following proportions of ingredients by weight:

| Ingredient | Amount | Range |
|---|---|---|
| Sodium azide ($NaN_3$) | 57.9% | ±10% |
| Iron oxide ($Fe_2O_3$) | 34.6% | ±10% |
| Graphite | 3% | 0 to 6% |
| Bentonite | 2.5% | 0 to 5% |
| Sodium Nitrate ($NaNO_3$) | 2% | 0 to 10% |

It should be understood that the composition of the body 10 of gas generating material could be different than the specific composition set forth above. For example, an alkali metal azide other than sodium azide could be used. Also, a different oxidizer could be used. Although graphite fibers are preferred to provide mechanical reinforcement, other fibers could be used, such as glass fibers and iron fibers. Extrusion aids other than bentonite could be used and/or oxidizing agents other than sodium nitrate could be used, such as ammonium perchlorate.

The body 10 has a generally cylindrical shape and has a cylindrical central passage 7 with an axis disposed on the central axis of the grain. The passage 7 extends between axially opposite end faces of the body. In addition, the body 10 has a plurality of cylindrical passages 8 which are disposed radially outwardly relative to central passage 7 and which also extend longitudinally through the body between the opposite end faces.

The axes of the passages 8 are parallel to the axis of passage 7. The passages 8 are evenly spaced, on concentric circles which are radially spaced from passage 7, but which are co-axial with the axis of passage 7. As shown in FIG. 1, the axes of the passages 8 on one of the concentric circles are offset circumferentially, to one side, from the axes of the passages 8 on the other concentric circles. In this respect, a passage 8 on a first concentric circle is spaced from an offset passage on an adjacent concentric circle the same distance that it is spaced from an adjacent passage 8 on the first concentric circle.

When used to inflate an airbag, the plurality of bodies 10 are stacked so that the passages in one body are aligned with the passages in all of the other bodies. The surfaces of the bodies including the surfaces of the passages of all of the bodies are quickly ignited. Hot gas is generated by burning of the bodies.

The gas which is generated within the passages must be able to get out of the passages and flow radially from the bodies into an airbag to inflate the airbag. To provide for such flow, spaces are provided between the end faces of adjacent bodies 10. The spaces extend radially outward from the central passage 7 of the bodies. The spaces between the ends of adjacent bodies are provided by axially projecting standoff pads 9 on the end faces. As disclosed in prior U.S. Pat. No. 4,817,828, the standoff pads of one body are aligned with those of an adjacent body so that the spaces between the bodies are provided by the standoff pads of adjacent bodies. Several standoff pads 9 are positioned in circumferentially spaced apart relationship on each end face so as to maintain the end faces of adjacent bodies in spaced apart parallel planes.

The plurality of passages 7, 8 in a body 10 promote what has been referred to as a progressive rate of burn of a body. A progressive rate of burn is one in which the burning proceeds, for a substantial part of the burn cycle, at a rate which increases. As the circumferential surfaces of the passages burn, the passages widen, exposing increasingly more surface area to burning. Simultaneously, the outer circumference of each body 10 shrinks, reducing the surface area exposed to burning, but this reduction in surface area is less than the increase in surface area produced by burning in the passages in the body. At a point in the burn cycle, the burn rate ceases to increase and remains constant until near the end of the burn cycle, at which time the rate of burn will decrease to zero.

First Embodiment of the Invention

Figure 3:
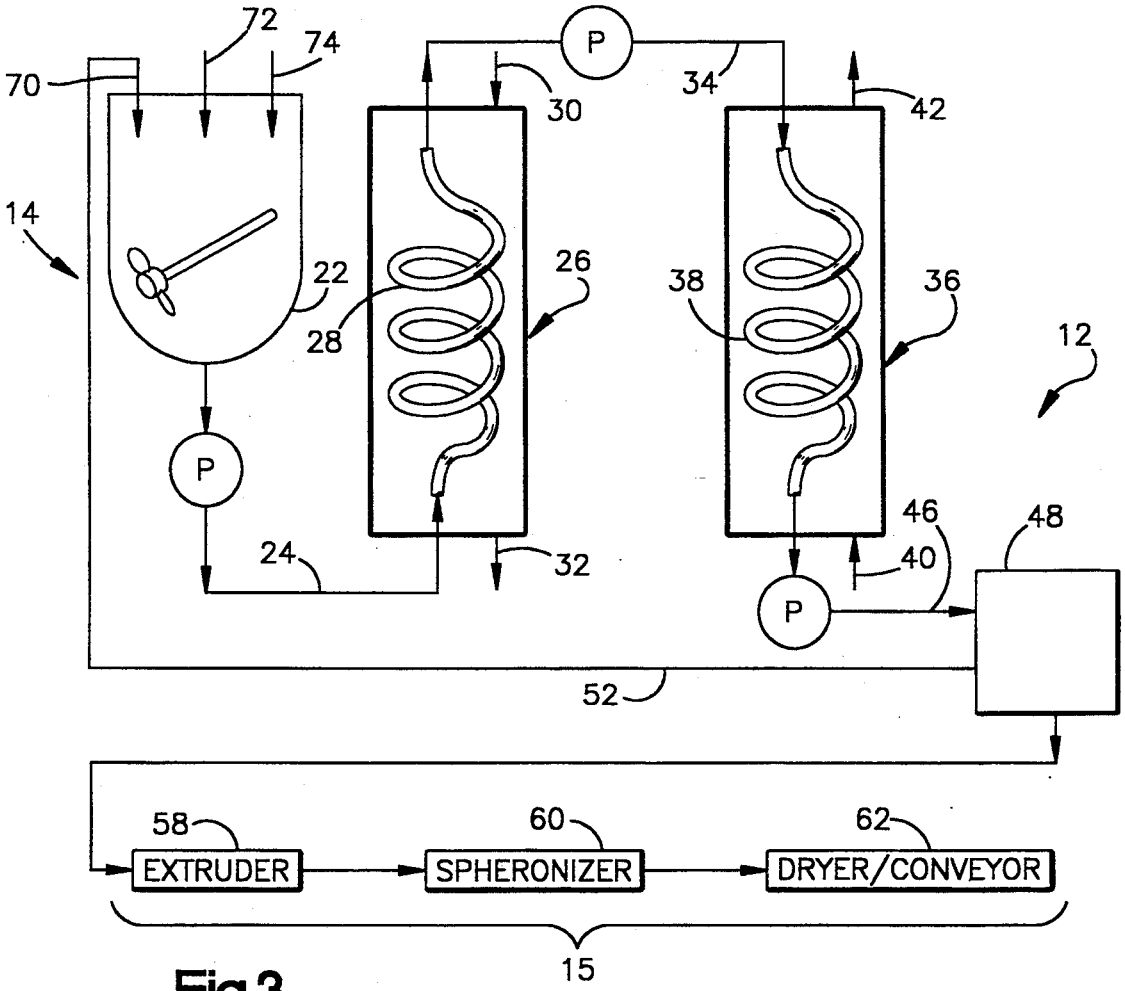
FIG. 3 is a schematic illustration depicting a method of manufacturing gas generating material for forming the body of gas generating material illustrated in FIGS. 1 and 2.

The gas generating material used in the body 10 is manufactured in a process using the apparatus 12 illustrated schematically in FIG. 3. The apparatus 12 includes first stage process equipment 14 which is used to prepare a wet mixture of the gas generating material and second stage processing equipment 15 which is used to process the wet mixture of gas generating material. The first stage processing equipment 14 is used to prepare an initial wet mixture of sodium azide ($NAN_3$), sodium azide dissolved in a solvent (preferably water), iron oxide ($Fe_2O_3$) and other materials, if used, such as sodium nitrate ($NANO_3$), graphite and bentonite. These materials are mixed in a tank 22 at room temperature.

The mixture in the mixing tank 22 is pumped, preferably continuously, from the mixing tank 22 through a conduit 24 to a heater 26. The heater 26 includes a coil 28 through which the mixture including the sodium azide solution passes. High temperature fluid, such as steam, is conducted to and from the heater 26, in the manner indicated schematically by the arrows 30 and 32, to heat the mixture as it moves through the coil 28. As the mixture is heated, the solubility of the sodium azide in the solvent increases. By the time the mixture reaches the end of the coil 28 and is moving out of the heater 26, the solvent is heated to a temperature sufficient to enable all of the sodium azide particles in the mixture to dissolve into the solvent. When the hot mixture leaves the heater 26, the metal oxide particles are suspended in the solution containing dissolved metal azide.

The mixture of hot aqueous based metal azide solution with the metal oxide particles suspended therein is pumped through a conduit 34 to a cooler 36. The cooler 36 includes a cooling coil 38 through which the mixture flows. The mixture is cooled as it flows through the cooling coil 38. A cold cooling liquid flows into and out of the cooler 36, in the manner indicated by the arrows 40 and 42 in FIG. 3. The cold cooling liquid is preferably an ethylene glycol and water mixture.

As the aqueous based solution of metal azide is cooled in the coil 38, metal azide precipitates out of solution. During the precipitation of the metal azide, the iron oxide particles act as nuclei around which the metal azide collects. This results in the iron oxide particles suspended in the solution being coated with the metal azide. Particles of other materials such as graphite and bentonite in the mixture will also be coated with sodium azide. The relatively cold mixture containing metal azide coated metal oxide particles is pumped from the cooler 36 through a conduit 46 to a suitable liquid solid separating device 48 such as a continuous centrifuge or filter.

The liquid solids separating device 48, separates the solids, including the metal azide coated particles of metal oxide, from the liquid, preferably continuously. The moisture content by weight of the separated solids is on the order of about 6%–10%. The liquid filtrate, which is an aqueous based solution containing some sodium azide, is conducted through a conduit, 52 back to the mixing tank 22 and reused, as indicated by arrow 70. By reusing the liquid filtrate, the disposal of the liquid as waste is avoided. Since during the process the aqueous based metal azide solution is open to the air only when the solution is at room temperature or below, there is little potential for hydrazoic acid formation.

The wet mixture of solids, that is, the gas generating material, from the liquid solids separating device 48 is conducted to an extruder 58. The extruder 58 forms the wet mixture of gas generating material into generally cylindrical extrudate. This is done by forcing the wet mixture of gas generating material through small openings as is known.

Figure 2:
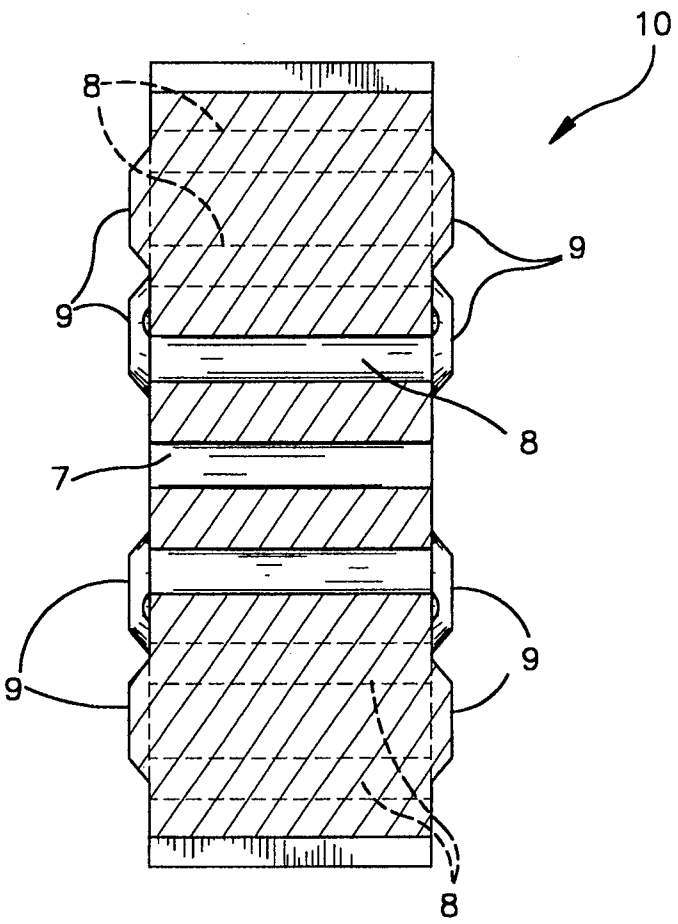
FIG. 2 is a sectional view, taken generally along the line 2—2 of FIG. 1, further illustrating the construction of the body of gas generating material.

The cylindrical extrudate of gas generating material is formed into a spherical shape by a spheronizer 60. The spheres of gas generating material are then conducted to a continuous dryer 62 in which they are dried to a moisture content of about 3% as they are moved through the dryer. The spheres are subsequently molded, in a known manner, to form the bodies 10 (FIGS. 1 and 2) of gas generating material. Since the process produces an intimate coating of sodium azide on the iron oxide particles, the gas generating material has a high pyrotechnic performance.

The wet mixture of gas generating material conducted from the liquid solids separating device 48 to the extruder 58 must contain a predetermined amount of sodium azide. Therefore, the amount of sodium azide which is precipitated from the hot solution of sodium azide in the cooler 36 must be accurately controlled. The amount of sodium azide which is precipitated from the hot solution in the cooler 36 over time is determined by first subtracting the amount of sodium azide dissolved in the cold solution leaving the cooler from the amount of the sodium azide dissolved in the hot solution entering the cooler. The result of the substraction is then multiplied by the mass flow rate of the solution through the cooler.

The amount of the sodium azide precipitated from the solution will vary as a function of the temperature differential between the hot solution conducted into the cooler 36 and the cold solution conducted from the cooler. Thus, the higher the temperature of the solution conducted into the cooler 36 and the lower the temperature of the solution conducted from the cooler, the greater will be the amount of sodium azide precipitated from the solution in the cooler for a given mass flow rate of the solution through the cooler. The solution is conducted from the heater 26 to the cooler 36 with the solution preferably at a temperature above 200° F. and most preferably at a temperature of 220° F. or higher. The temperature of the solution conducted from the cooler is below 40° F. and preferably at a temperature of 34° F. or lower.

When the aqueous based azide solution is at a temperature of 220° F., the assay (amount) of the dissolved sodium azide in the solution is 34.6% by weight of the azide iron oxide mixture. When the temperature of the same aqueous based solution is at 34° F., the assay (amount) of the dissolved sodium azide in the solution is 21% by weight of the azide/iron oxide mixture. Therefore, if the rate of flow through the heater 36 is 100 lbs. per minute of the azide solution containing iron oxide, the rate of precipitation of sodium azide from the solution and onto the solids suspended in the solution is 13.6 lbs. per minute. To avoid amounts of sodium azide depositing on the walls of the conduit in the cooler 36 the conduit is made of suitable material such as teflon coated steel or glass coated steel. Preferably 22.6 lbs. of sodium azide coated particles of iron oxide are removed by the liquid solid separating device per minute at the 100 lbs./minute flow rate.

Assuming a 100 lb. mixture of a saturated solution of water and sodium azide and iron oxide, at 220° F. there would be 56.4 lbs. of water, 34.6 lbs. of sodium azide dissolved in the water and 9 lbs. of iron oxide. This same 100 lb. mixture at 34° F. would contain 56.4 lbs. of water, 9 lbs. of iron oxide, 21 lbs. of sodium azide in solution and 13.6 lbs. of sodium azide precipitate.

As was previously discussed, the gas generating material contains approximately 60% sodium azide and approximately 40% iron oxide (ignoring the other ingredients). Therefore, initially, for every pound of fresh water added to the mixing tank 22, approximately 0.61 lbs. of sodium azide and approximately 0.16 lbs. of iron oxide are added to the mixing tank. Once the process has been established, the filtrate from the filter 48 is added to the mixing tank 22 in the manner indicated by the arrow 70 in FIG. 3. The sodium azide is added in the manner indicated by the arrow 72 .and the iron oxide, sodium nitrate, bentonite and graphite are added in the manner indicated by the arrow 74 in FIG. 3. Since the filtrate conducted from the filter 48 to the conduit 52 to the mixing tank 22 is saturated with sodium azide at a temperature of preferably 34° F., for each pound of this filtrate, 0.24 lbs. of sodium azide and 0.16 lbs. of iron oxide are added to the mixing tank 22. In addition, since some liquid is removed from the process in the solids which are directed to the extruder 58, some fresh makeup water is added to the mixing tank 22.

Second Embodiment of the Invention

Figure 4:
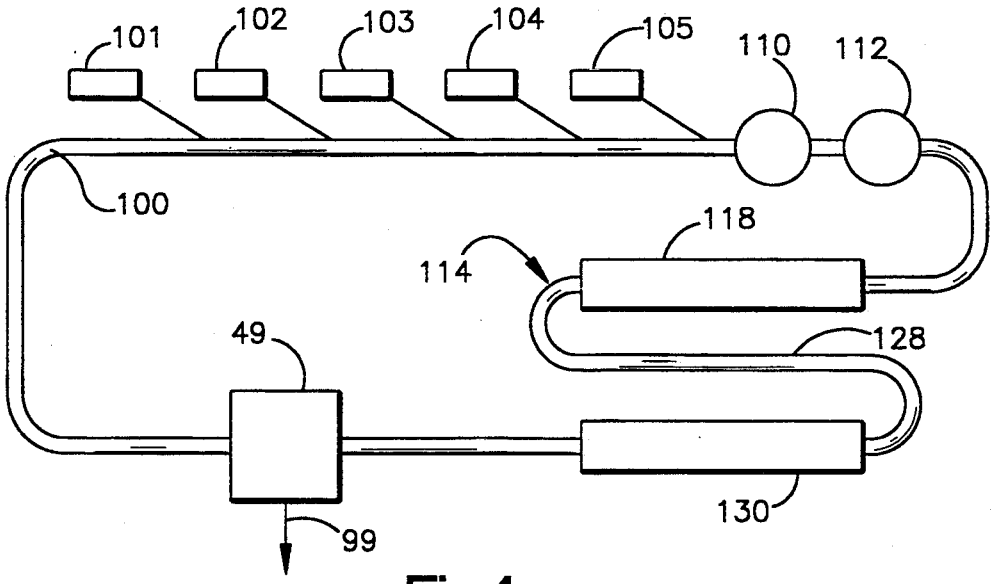
FIG. 4 is a schematic illustration, generally similar to FIG. 3, illustrating a second embodiment of the method of manufacturing gas generating material.

In the embodiment described above and shown in FIG. 3, the various materials are mixed in a mix tank 22. In the embodiment shown in FIG. 4, the materials are not mixed in a mix tank, such as tank 22. As shown in FIG. 4 the materials are individually directed into a conduit 100 from feeders that weigh and feed the appropriate amount of material into the conduit 100. When the materials are in the conduit 100, the materials are not exposed to the air, so that hydrazoic acid does not form.

The conduit 100 receives metal azide, preferably sodium azide from feeder 101, receives metal oxide, preferably iron oxide, from feeder 102, receives sodium nitrate from feeder 103, receives bentonite from feeder 104 and receives graphite from feeder 105. As an alternative, the iron oxide, sodium nitrate, bentonite and graphite could be preblended and fed into conduit 100 by the same feeder. The conduit 100 also receives the cold filtrate removed by the liquid solids separation device 49 and also receives water, (not shown). The process is continuous in that the materials continuously flow through the system.

The conduit 100 directs the materials into a conventional colloid mill 110. The colloid mill 110 thoroughly mixes.the various materials together. The colloid mill 10 does not grind any material. The mixture from the colloid mill 110 is then directed into a positive displacement pump 112, which is a known progressive cavity pump. The pump 112 forces the mixture to flow, in a turbulent manner through heat transfer processing equipment 114. Because of the turbulent flow the iron oxide particles remain suspended in the mixture.

The heat transfer processing equipment 114 includes a heater 118 in which the material is heated. The mixture to be heated is directed by pump 112 through an inside conduit (not shown) of heater 118 and steam is directed through an outside conduit (not shown) surrounding the inside conduit. The mixture is heated as it flows through the inside conduit. In one specific embodiment of the heater 118, the inside conduit is a $\frac{3}{8}$ inch in diameter pipe and the outside conduit is a $\frac{5}{8}$ inch in diameter pipe. The mixture is heated to above 200° F. and preferably above 220° F. in the heater 118.

After being heated, the mixture flows through a length of conduit 128. The mixture as it flows through conduit 128 is neither heated nor cooled. When the mixture is flowing through the conduit 128, the metal azide is being dissolved. Flow through the conduit 128 provides time during which the metal azide dissolves into solution. The amount of metal azide used and the temperature to which the mixture is heated is such that the metal azide completely dissolves into solution.

After the metal azide is completely dissolved into solution, the hot mixture containing iron oxide particles and other materials is directed into a cooler 130. The cooler 130 includes a plurality of conduits. In one specific embodiment of the cooler 130, the hot mixture is conducted through $\frac{3}{8}$ inch in diameter pipes which are surrounded by $\frac{5}{8}$ inch in diameter pipes carrying a cold ethylene glycol-water cooling liquid. The mixture, when it exits from the cooler 130, is at a temperature below 40° F. and is preferably at about 34° F. or a lower temperature. Because of the cooling, metal azide precipitates from solution and coats the iron oxide particles as in the embodiment of FIG. 3.

After cooling, the mixture is directed to the liquid solids separation device 49 which separates the solids from the filtrate (liquid). The liquid solids separating device 49 is a conventional mechanism which separates the solids and liquid as the material flows through the liquid solids separating device, and may be a continuous centrifuge. The liquid filtrate is then directed through conduit 100 to be reused. The solids are directed, as indicated by arrow 99 and as in the embodiment of FIG. 3, to an extruder, spheronizer, and dryer. Subsequently, the material in the form of spheres is formed into gas generating bodies as shown in FIG. 1.

Third Embodiment of the Invention

Figure 5:
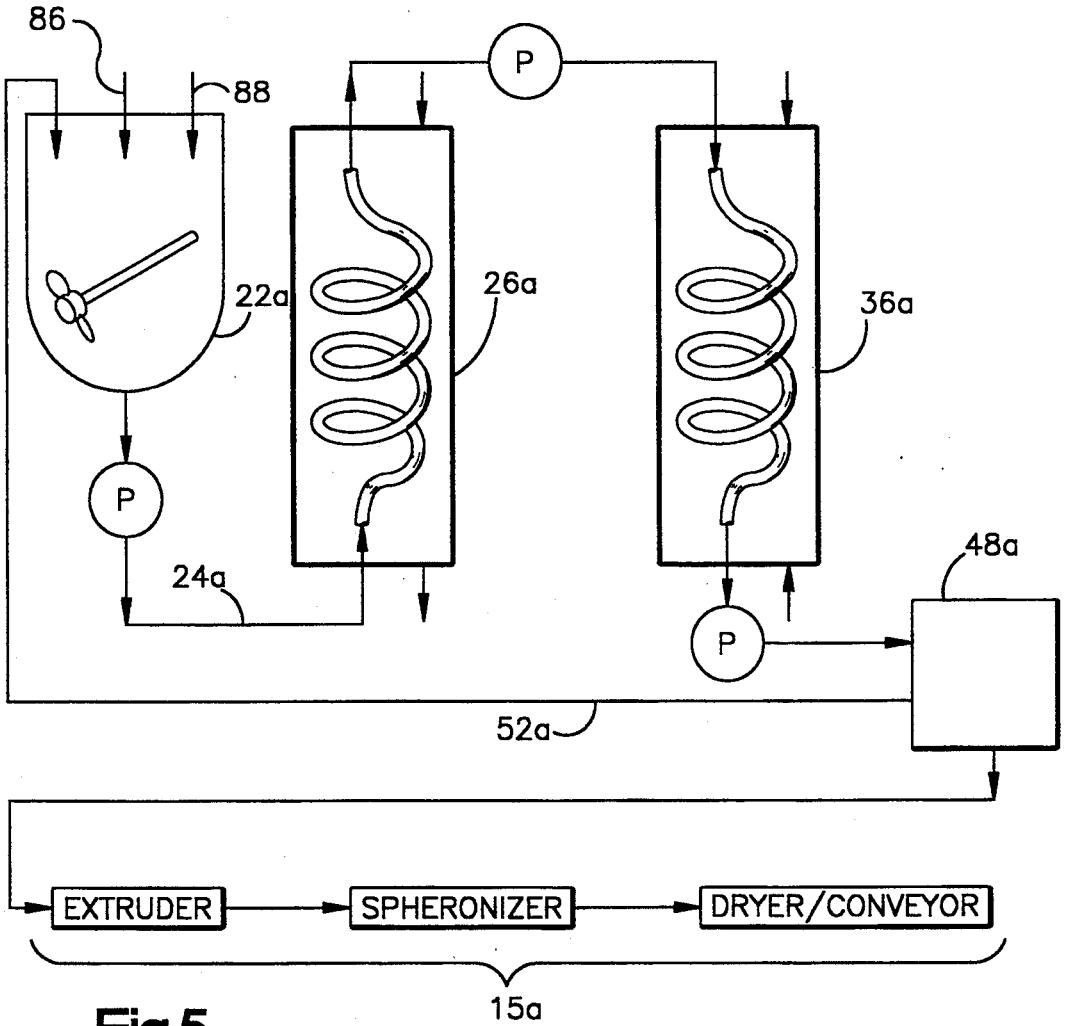
FIG. 5 is another schematic illustration illustrating still another embodiment of the method of manufacturing gas generating material.

Another embodiment of the present invention is illustrated in FIG. 5. In this embodiment, the manufacture of the gas generating material and the manufacture of sodium azide are integrated into the same process. A substantial portion of the cost of making sodium azide is drying of the sodium azide. In order to eliminate this cost, sodium azide may be used to make gas generating material in accordance with the present invention without being dried. This process is illustrated schematically in FIG. 5. Since many of the components of the embodiment of the invention illustrated schematically in FIG. 5 are the same as components of the embodiment of the invention illustrated in FIG. 3, similar numerals will be utilized to designate similar components, the suffix letter "a" being associated with the numerals of FIG. 5 to avoid confusion.

It is contemplated that any known process which forms sodium azide may be integrated into the same process with the manufacture of the gas generating material. Thus, one known process may be used, specifically the liquid phase process, as described in the text *Encyclopedia of Explosives and Related Items, Volume 1* by Basil T. Fedoroff, Picatinny Arsenal, Dover, N.J., U.S.A. (1960). The process is described in this text as follows: Five twelve pound bricks of sodium were melted in an electrically heated melter and the molten sodium at 350° F. (176.7° C.) dropped into a high-pressure autoclave containing 375 pounds of liquid ammonia and 1 pound ferric nitrate catalyst. The sodium reacted to form sodium amide and hydrogen:

$$2Na+2NH_3 \rightarrow 2NaNH_2+H_2,$$

the latter being vented out of the autoclave along with some ammonia at a gage pressure of 300 psi. The temperature was held below 105° F. (40.6° C.) by cold water in the autoclave jacket. When this reaction had subsided, the remaining hydrogen was vented and about 55 pounds of nitrous oxide gas was added to the charge through a standpipe the end of which was directed beneath the gas disperser agitator in the autoclave. The following reaction took place:

$$2NaNH_2+N_2O \rightarrow NaN_3+NaOH+NH_3.$$

In this operation as much of the $N_2O$ as possible was fed continuously and at such a rate that the concentration of $N_2O$ in the vapor space was less than 25% by volume, to prevent forming an explosive mixture with $NH_3$. When no more $N_2O$ was absorbed, the charge was blown into a 246 gallon drowning tank which contained enough water to give a final solution strength of 8% $NaN_3$. The yield from sodium to $NaN_3$ in the crude solution was 87%. The next step was removal of ammonia from the crude solution. This was done in an evaporator, by adding water to the evaporator and steam stripping ammonia from the evaporator to an ammonia recovery system.

The sodium hydroxide is then removed. This may be done by removing water from the ammonia-free crude solution, by boiling, until the saturation point of the sodium hydroxide is reached. At this point, the crude solution contains crystals of sodium azide. The crude solution is filtered through a suitable filter to obtain a slurry having about 6%–17% by weight liquor and about 90%–94% by weight sodium azide crystals. Sodium hydroxide is removed in the filtrate. The liquor in the slurry is about 50%–75% by weight of sodium hydroxide and about 50%–25% by weight of water.

If it is desired to remove more sodium hydroxide, additional steps can be taken. Water can be added to the slurry and the slurry again filtered. This would further reduce the amount of sodium hydroxide in the slurry. The slurry would be about 90%–94% sodium azide crystals and 6%–17% liquor but the amount of sodium hydroxide in the liquor would be reduced.

The resulting wet sodium azide crystals are moved directly to a mixing tank **22*a* in the manner indicated by the arrow 86 in FIG. 5. Iron oxide is added to the mixing tank 22*a* in the manner indicated by the arrow 88 in FIG. 5**. Thus, the sodium azide remains wet from the inception of the sodium azide until the iron oxide particles are added. No drying of the sodium azide crystals is necessary.

In addition, other ingredients, such as graphite, bentonite and sodium nitrate may be added to the mixing tank 22a. Also, fresh water is added to the mixing tank 22a to provide the desired amount of solvent for the sodium azide. If desired, the amount of sodium azide in the tank 22a can be adjusted by adding dry sodium azide to the mixing tank 22a.

The mixture is conducted from the mixing tank 22a through the conduit 24a to the heater 26a. The mixture conducted to the heater 26a is saturated with sodium azide and contains particles of both sodium azide and iron oxide. The mixture is heated in the heater 26a to a relatively high temperature, on the order of 220° F. or higher. Due to the increasing solubility of the sodium azide in the aqueous solvent with increasing temperature, the sodium azide particles are dissolved as the mixture is heated. All of the sodium azide is dissolved into solution.

The mixture is then pumped from the heater 26a to a cooler 36a. In the cooler 36a, the temperature of the mixture is decreased to a relatively low temperature, that is 34° F. or lower. Due to the loss of solubility of the sodium azide in water with the decrease in temperature, the sodium azide is precipitated from solution and coats the iron oxide particles in the manner previously explained.

The mixture containing the sodium azide coated particles of iron oxide is pumped from the cooler 36a to a liquid solids separation device 48a. The liquid solids separation device 48a separates the solids from the liquid. The liquid filtrate is conducted from the liquid solids separation device 48a back to the mixing tank 22a through a conduit 52a. The solids, that is, the wet mixture of gas generating material, are conducted from the liquid solids separation device to the processing apparatus 15a. The gas generating material is then processed in the manner previously explained. Although the foregoing description of how the sodium azide is formed and processed has been made in conjunction with the apparatus of FIG. 5, the manufacture of the sodium azide could also be incorporated in an apparatus similar to the apparatus of FIG. 4 and in the process in which the apparatus of FIG. 4 is used.

From the above description of the invention, those skilled in the art will perceive improvements, changes and modifications. Such improvements, changes and modifications within the skill of the art are intended to be covered by the appended claims.

Having described the invention, the following is claimed:

1. A process of manufacturing a gas generating material comprising the steps of:

preparing a hot solution at a temperature $T_1$, of a metal azide with metal oxide particles suspended in the solution, precipitating the metal azide from the solution onto the metal oxide particles by cooling the hot solution to a temperature $T_2$, said cooling being by indirect heat exchange with a cooling fluid, and thereafter, removing the metal azide precipitate and the metal oxide particles from the solute, the temperatures $T_1$, and $T_2$ providing a ratio of precipitated metal azide to suspended metal oxide which is effective for reaction of the metal azide with the metal oxide.

2. The process of claim 1 wherein the metal azide is an alkali metal azide and the solvent is water, the hot solution of metal azide being saturated.

3. The process of claim 2 wherein said azide is sodium azide and the temperature $T_1$ is greater than about 200° F. and the temperature $T_2$ is less than about 40° F.

4. The process of claim 3 wherein said metal oxide is iron oxide, and the assay of dissolved sodium azide in the hot solution is about 34.6% and the assay of the dissolved sodium azide of the cooled solution is about 21%.

5. The process of claim 1 wherein the heating is performed in a closed heating chamber.

6. The process of claim 1 performed on a continuous basis including a heating zone for preparing the hot solution, a cooling zone for cooling the hot solution, a separation zone for removing the precipitate and metal oxide particles from the solute, and a mixing zone for providing a feed to said heating zone, further including the step of continuously recycling solute from the separation zone to the mixing zone.

7. The process of claim 6 wherein said process is essentially a closed chamber process except the mixing zone further including the step of maintaining the mixing zone at a temperature below the boiling point of hydrozoic acid.

8. A continuous process of manufacturing a gas generating material comprising the steps of:

preparing a hot solution of a metal azide in a heating zone at a predetermined assay with metal oxide particles at a predetermined concentration suspended in the solution, continuously maintaining said solution at said metal azide assay and said metal oxide concentration;

continuously feeding said solution to a cooling zone, continuously precipitating the metal azide onto the metal oxide particles from said solution by cooling the hot solution in said cooling zone, said cooling being by indirect heat exchange with a cooling fluid and, thereafter, continuously removing the metal azide precipitate and the metal oxide particles from the solute in a separation zone.

9. The process of claim 8 including the step of continuously recycling the solute to said heating zone.

10. The process of claim 8 wherein the temperature of the solution in said heating zone is above about 200° F. and in the cooling zone is below about 40° F.

11. The process of claim 10 wherein the solvent of said solution is water, said metal azide is sodium azide and the assay of the dissolved sodium azide in said heating zone is about 34.6% and the assay of the dissolved sodium azide in said cooling zone is about 21%.

12. The process of claim 8 wherein the ratio of metal oxide in said cooling zone to precipitated sodium azide is that effective for substantially complete reaction of the metal azide with the metal oxide.

13. The process of claim 12 wherein the metal oxide is iron oxide and the metal azide is sodium azide and the weight ratio of metal oxide to metal azide is about 40/60.

14. The process of claim 8 including a mixing zone wherein the first heating zone is continuously fed from said mixing zone and the solute from the separation zone is continuously recycled to the mixing zone.

15. The process of claim 14 which is a closed chamber process except for the mixing zone, and the solvent of said solution is water, including the step of maintaining the mixing zone at a temperature below the boiling point of hydrozoic acid.

16. An essentially closed chamber process of manufacturing a gas generating material comprising the steps of:

preparing a hot solution of a metal azide with metal oxide particles suspended in the solution in a closed heating zone, precipitating the metal azide from the solution onto the metal oxide particles in a closed cooling zone by cooling the hot solution, said cooling being by indirect heat exchange with a cooling fluid, and, thereafter, removing the metal azide precipitate and the metal oxide particles from the solute in a closed separation zone.

17. The process of claim 16 wherein the heat transfer in said heating zone is indirect.

18. The process of claim 16 wherein said process in continuous.

19. The process of claim 18 including a mixing zone and further including the steps of providing a continuous feed from said mixing zone to said heating zone and a continuous recycle of solute from said separation zone to said mixing zone.

20. The process of claim 19 wherein the solvent of said solution is water, said mixing zone is open to atmosphere, and is maintained at a temperature below the boiling point of hydrozoic acid.

21. The process of claim 16 wherein the metal azide is sodium azide and the temperature of the solution in said heating zone is above about 200° F. and in said cooling zone below about 40° F.

22. The process of claim 21 wherein the assay of the dissolved sodium azide in said heating zone is about 34.6% and the assay of the dissolved sodium azide in the cooling zone is about 21%.

23. The process of claim 22 wherein the metal oxide is iron oxide and the ratio of precipitated sodium azide to iron oxide in the cooling zone is that effective for substantially complete reaction of the metal azide with the metal oxide.

24. A process of manufacturing a gas generating material comprising the steps of:

a) forming a metal azide by a process which includes making wet metal azide, b) adding metal oxide particles to the wet metal azide, c) maintaining the metal azide wet from the inception of the metal azide until after performing said step of adding metal oxide particles, d) preparing a hot solution of metal azide with the metal oxide particles suspended in the solution, e) precipitating the metal azide from the solution onto the metal oxide particles by cooling the hot solution, said cooling being by indirect heat exchange with a cooling fluid, the ratio of precipitated metal azide to suspended metal oxide being that effective for reaction of the metal azide with the metal oxide, and thereafter, f) separating the metal azide precipitate and metal oxide particles from the solute.

25. The process of claim 24 wherein said steps d), e) and f) are performed on a continuous basis, the temperature in step d) is greater than 200° F., the temperature in step e) is less than 40° F., and the flow rate during cooling is about 100 lbs./minute.

26. The process of claim 25 wherein the solvent of said solution is water and wherein the steps d), e), and f) are performed in essentially closed chambers, the temperature in steps b) and c) being below the boiling point of hydrozoic acid.

27. The process of claim 3 wherein the flow rate during cooling is about 100 lbs/minute.

28. The process of claim 10 wherein the flow rate during cooling is about 100 lbs/minute.

29. The process of claim 21 wherein the flow rate in the cooling zone is about 100 lbs/minute.

* * * * *